United States Patent [19]

Brotz

[11] Patent Number: 4,974,757

[45] Date of Patent: Dec. 4, 1990

[54] DISPENSER

[76] Inventor: Gregory R. Brotz, P.O. Box 1322, Sheboygan, Wis. 53081

[21] Appl. No.: 437,205

[22] Filed: Nov. 16, 1989

[51] Int. Cl.[5] ..... B65D 47/08

[52] U.S. Cl. ..... 222/562; 222/543; 222/556; 220/359

[58] Field of Search ..... 222/543, 562, 556; 220/359; 215/232, 233

[56] References Cited

U.S. PATENT DOCUMENTS

| | | | |
|---|---|---|---|
| 1,924,242 | 7/1932 | Kaye | 222/543 |
| 2,041,185 | 5/1936 | Jacobs | 222/556 |
| 2,911,128 | 11/1959 | Krautkrämer | 222/543 |
| 3,036,746 | 5/1962 | Hagen | 222/556 |
| 3,416,688 | 12/1968 | Fanning | 222/543 |
| 4,146,152 | 3/1979 | Ogawa et al. | 222/151 |
| 4,215,797 | 8/1980 | Chen | 220/359 |
| 4,457,458 | 7/1984 | Heinol | 222/556 |
| 4,473,168 | 10/1984 | Cox | 220/359 |
| 4,669,640 | 6/1987 | Ando et al. | 220/359 |
| 4,705,197 | 11/1987 | Gordon et al. | 222/556 |
| 4,878,599 | 11/1989 | Greenway | 222/1 |

FOREIGN PATENT DOCUMENTS

| | | | |
|---|---|---|---|
| 739997 | 11/1955 | United Kingdom | 222/543 |

*Primary Examiner*—Andres Kashnikow
*Assistant Examiner*—W. Todd Waffner
*Attorney, Agent, or Firm*—William Nitkin

[57] ABSTRACT

A dispensing system for a container holding hardenable materials having a closure member, a platform area at the top of the container, an opening defined in the platform extending into the container to form a passage whereby when the closure member is in its open mode hardenable material passes through the passage from the interior of the container and is deposited on the top of the platform. When the closure member is in its closed mode, it is adapted to flatten the hardenable material on the platform, allowing the edges of flattened material to harden and to be manually removed for continued dispensing of hardenable material.

5 Claims, 1 Drawing Sheet

DISPENSER

BACKGROUND OF THE INVENTION

1. Field of the Invention

The structure of this invention resides in the area of container with closure means and more particularly relates to a dispenser for the dispensing of materials that harden when exposed to air.

2. Description of the Prior Art

Tubes with dispensing means for the dispensing of hardenable material such as silicon sealants and the like are well known in the prior art. Such tubes generally consist of an elongated nozzle with a cap at the end thereof through which nozzle the hardenable material is dispensed. A problem with the prior art is that the material, which hardens upon contact with air, will often harden within the elongated nozzle, making it very difficult to dispense the remaining material held within the container unless one first spends time digging out the hardened material within the nozzle. Many times it is impossible to clean out such nozzles.

SUMMARY OF THE INVENTION

It is an object of this invention to provide a container and associated cap for the dispensing of hardenable material in a fashion that will prevent the dispensing means from becoming plugged even though some material may harden.

It is a further object of this invention to provide a new dispensing system for a container which allows a portion of the hardenable material to harden as part of the operation of the system with the portion of hardened material to be easily removed, allowing the user to dispense more of the remaining unhardened material in the container. The dispensing system can also be used to dispense viscous liquids likes non-curing resins such as would be mixed as a two-component epoxy.

The device of this invention includes a closure member on a hinge which can be plastic which closure member is disposed above the top of the container, such container having a passage and passage opening at the top of the container. The top of the container has a platform which can be oval in shape onto which the passage opens. The passage can be disposed toward one side of the platform near the hinge of the closure member. The closure member can be moved downward on its hinge above the platform. One dispenses the hardenable material from the container through the passage opening when the closure member is in its open mode. When the closure member is in its closed mode, it does not meet flush with the platform surface of the top of the container but compresses the dispensed material thereby forming an oval-shaped portion of material under the closure member where the edges of the thus sandwiched material are exposed to the air. The material at these edges will harden in normal fashion. When hardened, such edges protect the unhardened interior of the material under the central portion of the closure member from hardening.

In use when one desires to dispense the material again, one would flip the closure member up away from the platform, exposing the hardened edge of the material on the platform. One would then grasp and peel off the hardened edges which will come off intact and throw the hardened edge portion away. One can then dispense material through the passage opening at the top of the container which only has soft, unhardened material thereabove which can be easily dispensed. The dispenser of this invention is desirable for dispensing caulking, silicon sealant material or any material which hardens upon contact with air. The dispenser can have an openable and closeable bottom so that in one embodiment it can be refilled and reused.

DESCRIPTION OF THE PREFERRED EMBODIMENT(S)

Figure 1:
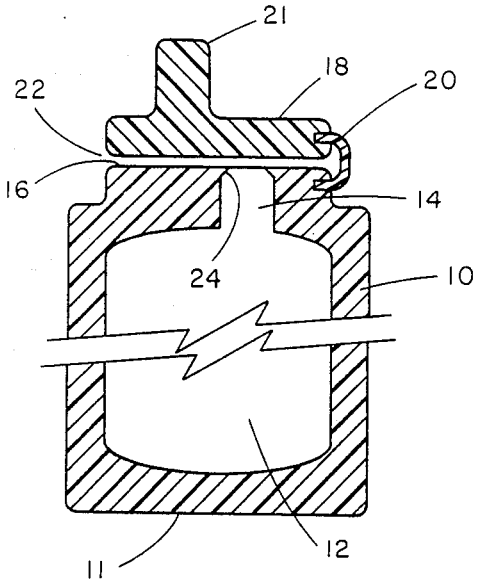
FIG. 1 illustrates a cross-sectional elevational view of the dispenser of this invention in a closed position.

FIG. 1 illustrates a cross-sectional elevational view of container 10 having closure member 18 of this invention thereon shown with the middle portion of the container cut away. Container 10 holds a material that hardens upon contact with air which material can be dispensed by squeezing the container or by forcing the contents at the bottom 11 of the container upward by various means such as by pistons or the like. At the top of container 10 is the opening of passage 14 through which passes the hardenable material onto platform 16 which platform can be oval in shape. Closure member 18, which can also be substantially oval in shape, is disposed above platform 16 and is hinged at one side by hinge 20 which can be a strip of plastic or equivalent, such hinges being well known in the art. Grasping member 21 can protrude from the closure member to be used for grasping the closure member easily to open it by pulling upwards and laterally to the side. Grasping member 21 can be used, in one embodiment, to secure closure member 18 in an open mode when the dispenser is being used which use is described further below.

Figure 2:
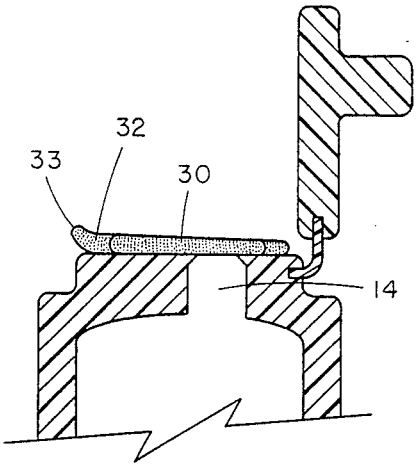
FIG. 2 illustrates a cross-sectional view of the top of a container with its closure member in an open position with some previously dispensed material remaining on the platform of the container.

In use, one dispenses the hardenable material through passage 14, also seen in FIG. 2, some of which material remains on platform 16 after use. When one is finished dispensing the desired amount of material, one would press closure member 18 down until it made contact with the material on platform 16, causing the material on the platform to be compressed and flattened on the platform. Space 22 between the bottom of closure member 18 in its closed mode and platform 16 is thus filled with an oval-shaped portion of material. The stickiness of the material filling space 22 helps hold the closure member in its closed mode as well as does the vacuum produced between the material, platform and closure member bottom. The material within space 22, seen in FIG. 1, forms a central unhardened portion 30, as seen in FIGS. 2 and 5, and a hardened edge 32 around the material's circumference 32 as the edge is exposed to air.

Figure 4:
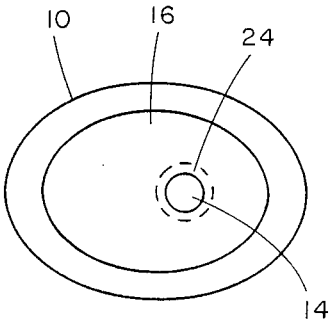
FIG. 4 illustrates a top view of the platform of the container of this invention showing the location of the passage opening in the platform.

FIG. 4 illustrates a top view of oval-shaped platform 16 with closure member 18 not shown. The top opening of passage 14 is shown with a dotted circle representing the actual width of the passage, which passage allows the flow of materials up onto platform 16.

Figure 5:
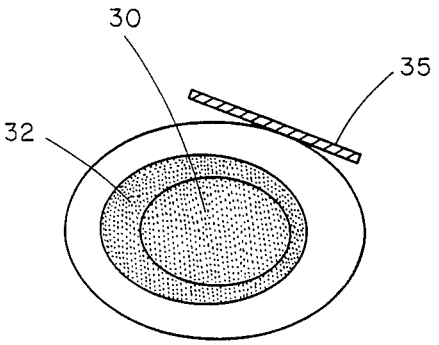
FIG. 5 illustrates a view of the platform with hardenable material dispensed thereon with the closure member (not seen) in its open mode with the hardened edges and unhardened central portion of the material on the platform delineated by different shading.

After material 12 has been dispensed and closure member 18, in its closed mode, covers platform 16, some of material 12 is compressed to a generally oval shape as seen in FIG. 5 as closure member 18 moves down on the material from one side. To dispense more material, one would lift up closure member 18, exposing platform 16 and then grasp the front of hardened portion 32 of the material which is seen somewhat lifted upwards at point 33 in FIG. 2. Hardened portion 32 is removed by lifting and peeling it away from platform 16. One then can dispense additional amounts of unhardened material 30 from the container. Platforms can be made of materials with high natural lubricity such as polypropylene, polyfluoro compounds and PTF plastics.

It is desirable when one is finished using the dispenser to scrape clean the platform and to squeeze out a little more fresh unhardened material to form the new seal between the platform and the closure member bottom. One can rub the platform over a workbench corner or use a knife-like surface to scrape the platform clean. If the hinge is flexible enough, one can move the closure member bottom against a scraper 35 seen in top view in FIG. 5 built into the cap, such scraper being disposed along a side of the platform protruding thereabove and from which scraper the excess material can be picked off by hand. Such a scraper can be useful when using quick-drying materials such as polystyrene in acetone glue.

Figure 3:
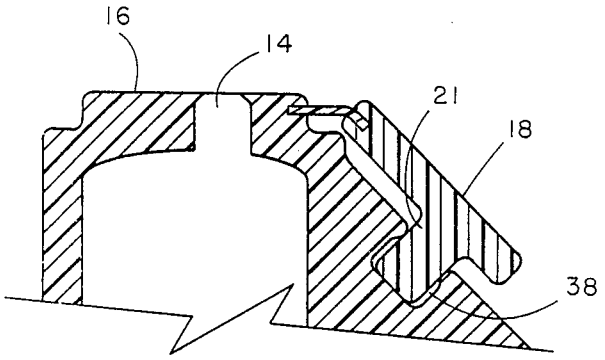
FIG. 3 illustrates a view of the device of this invention with the closure member retained in its open mode.

In another embodiment, such as seen in FIG. 3, friction receipt aperture 38 can be formed within the body of the container for receipt of grasping member 21 to releasably retain it so that closure member 18 will not be in the way of the flow of unhardened material.

Figure 6:
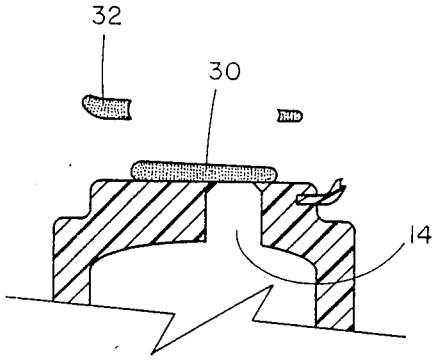
FIG. 6 illustrates the hardened edges of the material removed from the platform and with unhardened material remaining on the platform when the closure member (not seen) is in its open mode.

FIG. 6 shows a cutaway portion of hardened material 32 removed and peeled away from around unhardened material 30 so that further material can be dispensed through passage 14.

It is felt that the design of the dispenser of this invention whereby the hardening of the material is limited to an easily accessible amount forming on the edge of the material on the platform surface which hardened edges can be easily removed by the user avoids the problems of prior art dispensers of hardenable material where the hardening of the material can occur deep within nozzle areas which are often inaccessible to the user. Use of the dispenser of this invention will allow users to more completely dispense hardenable products without the problems encountered when hardenable material fills and hardens in the nozzles of prior art container/dispensers thereby making the remainder of the hardenable material unusable.

Although the present invention has been described with reference to particular embodiments, it will be apparent to those skilled in the art that variations and modifications can be substituted therefor without departing from the principles and spirit of the invention.

I claim:

1. A dispensing system for a container holding hardenable material, comprising:

a platform positioned at the top of said container;

an opening defined in said platform extending into said container to form a passage, said passage adapted to receive said hardenable material from within said container through said passage onto said platform;

a closure member;

hinge means attaching said closure member to said container, said hinge means adapted to position said closure member above said platform when said closure member is in its closed mode and to allow said closure member to be moved away from said platform when said closure member is in its open mode; and said closure member in its closed mode to be positioned above and substantially parallel to said platform with the edges of any material remaining on said platform under said closure member when said closure member is in its closed mode to be flattened and to harden at its edges when said edges are exposed to air, leaving the center portion of the dispensed material on said platform unhardened, said hardened edges adapted to be manually removed leaving the unhardened central portion of material above said passage able to be dispensed when further material passes through said passage.

2. The device of claim 1 further including a grasping member on said closure member.

3. The device of claim 2 further including catch means on the body of said container for releasably retaining said closure member in an open position.

4. The device of claim 1 wherein said platform is of an oval configuration to conform to the material's naturally formed configuration when pressed upon by said closure member closing thereon from one side.

5. The device of claim 4 wherein the top opening of said passage is disposed in said platform near said hinge means.

* * * * *